United States Patent [19]

Klumpp

[11] Patent Number: 4,668,846

[45] Date of Patent: May 26, 1987

[54] GRAVITY SENSING SWITCH FOR DETECTING INCLINATION

[76] Inventor: Henry B. Klumpp, P.O. Box 784, Fairhope, Ala. 36533

[21] Appl. No.: 907,164

[22] Filed: Sep. 15, 1986

Related U.S. Application Data

[63] Continuation of Ser. No. 815,405, Dec. 31, 1985, abandoned.

[51] Int. Cl.[4] ..... H01H 35/14

[52] U.S. Cl. ..... 200/61.45 R; 200/61.48; 200/61.51; 200/61.83

[58] Field of Search ..... 200/8 A, 11 A, 11 G, 200/11 J, 11 K, 61.45 R, 61.46, 61.48, 61.52, 61.83

[56] References Cited

U.S. PATENT DOCUMENTS

| | | | |
|---|---|---|---|
| 2,263,230 | 11/1941 | Young | 200/61.51 |
| 2,307,718 | 1/1943 | Barnet | 200/61.51 |
| 2,817,722 | 12/1957 | Johnson | 200/11 J |
| 3,183,316 | 5/1965 | Roeser | 200/11 K |
| 3,437,766 | 4/1969 | Ahrens | 200/11 J X |
| 3,859,651 | 1/1975 | Thomas, Jr. | 200/61.52 X |
| 3,975,722 | 8/1976 | Adler et al. | 200/61.83 X |
| 4,104,493 | 8/1978 | Hibino et al. | 200/61.48 X |
| 4,321,438 | 3/1982 | Emenegger | 200/61.48 X |
| 4,362,913 | 12/1982 | Kumita et al. | 200/61.48 X |

*Primary Examiner*—J. R. Scott

[57] ABSTRACT

A gravity sensing switch determines the level or plumb of an object and relays information with respect to level and/or plumb by a gravity sensitive rotor connected to a power input conductor and an electrical contact switching system connected to information output terminals.

6 Claims, 8 Drawing Figures

GRAVITY SENSING SWITCH FOR DETECTING INCLINATION

This application is a continuation of application Ser. No. 815,405, filed Dec. 31, 1985, now abandoned.

BACKGROUND OF THE INVENTION

Prior Art Devices used to determine the level or inclination of an object include the builders level, plumb bob and the inclinometer. The builders level is an instrument for determining or adjusting a surface with respect to horizontal and/or vertical planes. Two separate vials partially filled with liquid and an air bubble indicated when the instrument is located on an even horizontal or even vertical plane. The plumb bob is used to indicate vertical leveling. The inclinometer measures the inclination of an axis of an airplane or ship in relation to the horizon. These prior art devices can be made to indicate inclination with digital readout.

SUMMARY OF THE INVENTION

My invention can be adapted to replace the previously mentioned prior art devices with digital readouts. My gravity sensing switch is used under the influence of gravity to measure the inclination of an axis in the same manner as an inclination on airplanes and ships. If used on objects such as ships, my switch will detect the amount of list and in the case of airplanes, my switch will supply information in a 360° circle. The switch must be placed in a proper relationship with the object to obtain these results. When my gravity sensing switch is fastened to a straightedged device, it will give vertical and horizontal information concerning plumb or level. When used with light emitting diodes or sound devices, the switch can be used in dimly lit work areas with ease. These factors make my switch clearly superior to state of the art builders levels, plumb bobs, or other leveling devices now in use to detect inclination of an object.

DETAILED DESCRIPTION OF THE INVENTION

Figure 1:
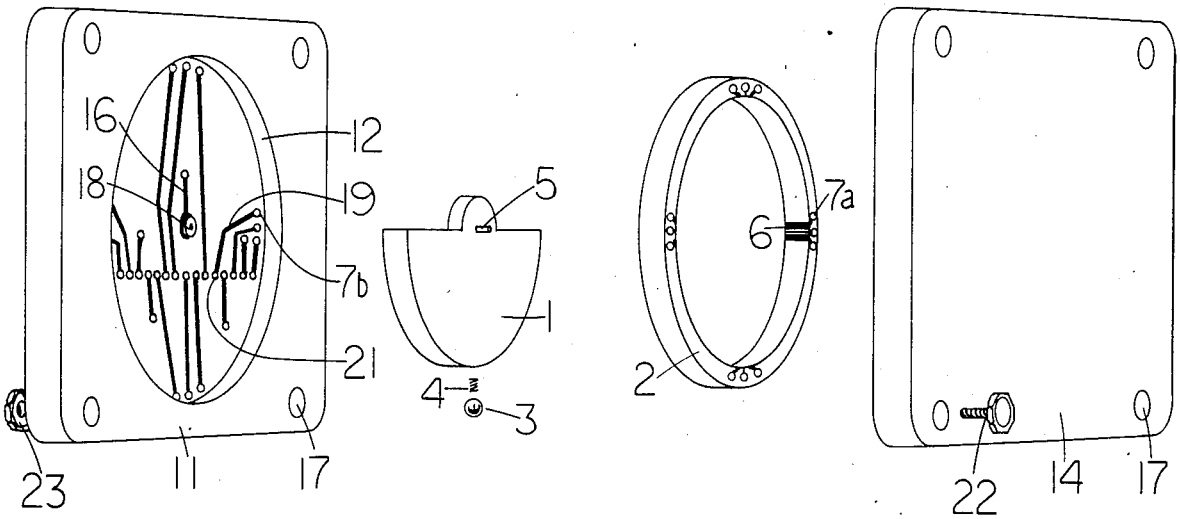
FIG. 1 is an exploded view of the switch.
Figure 2:
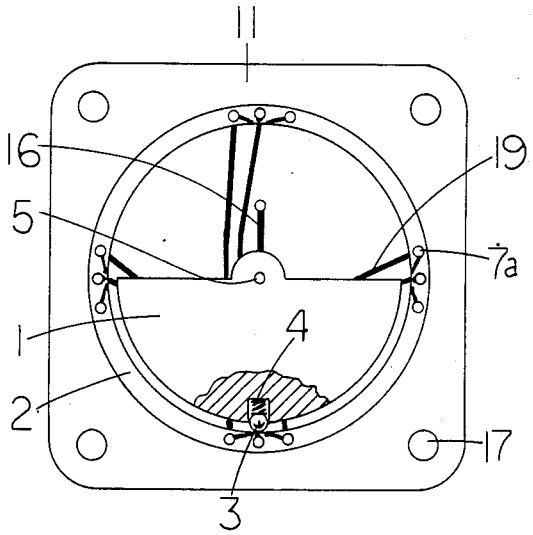
FIG. 2 is an elevation view of the backside housing containing the switch components.
Figure 3:
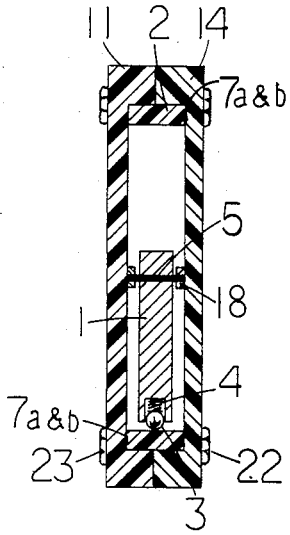
FIG. 3 is a cutaway section view of the switch.

In reference to the drawings, starting with FIG. 1, the backside switch assembly plate 11, has a built-in aperture cup 12, which contains the switch components. The general nonconductive switch housing is formed by the backside switch assembly plate 11 and a frontside retainer plate 14. The holes 17 allow plates 11 and 14 to be fastened together by fastener means such as nuts 23 and bolts 22. The current enters the switch at a power input terminal 16 and flows throughout the switch component assembly.

The components of the gravity sensing switch and assembly thereof are now discussed.

Two conductive axle bearing bosses 18 are centrally located and supported by the backside wall of the aperture cup 12 and the inside wall of the frontside retainer plate 14. This arrangement allows the coaxially aligned bosses 18 to receive a conductive rotor axle 5 which passes through the pivot point of a gravity sensitive rotor 1. The rotor 1 has a 360° rotational capability. A movable contact assembly consisting of a conductive spring 4 and movable contact 3 is located within a recess on the rotor's periphery. The rotor 1 may have more than one peripheral recess and contact assembly. A nonconductive circular race 2 is tightly fitted into the inner periphery of the aperture cup 12. The movable contact assembly interacts with flush mounted stationary contacts which are located within the inner periphery of race 2. Pressure lug contacts 7A are located in, preferably embedded within, the race 2. The pressure lug contacts 7A serve the purpose as electrical connectors between the stationary contacts 6 and pressure lug contacts 7B located on the backside assembly plate 12. The pressure lug contacts 7B are connected to informational output terminals 21 located on the backside assembly plate 11 through printed circuit segments 19.

When my gravity sensing switch is used to detect the level or plumb of an object, an electrical path is established in the following manner. Current flows through the power input conductor 16, conductive boss 18, rotor axle 5, conductive rotor 1, movable contact assembly 4 and 3, stationary contact 6, pressure lug contacts 7A and 7B, printed circuit segment 19 and information output terminal 21.

Figure 4:
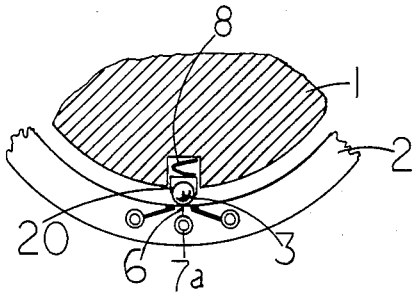
FIGS. 4 and 5 are enlarged views of the broken out rotor in FIG. 2 showing different movable contact assemblies.
Figure 5:
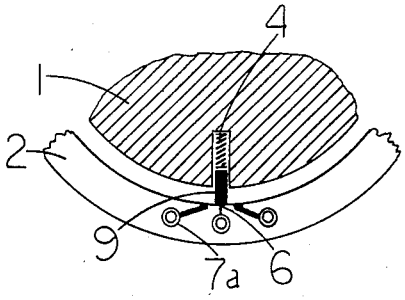
Figure 6:
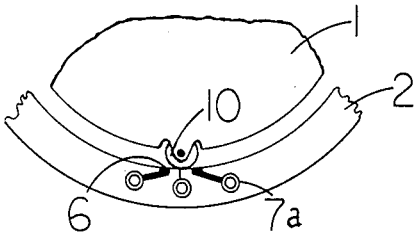
FIG. 6 is a partial view of a roller and axle switch contact.
Figure 7:
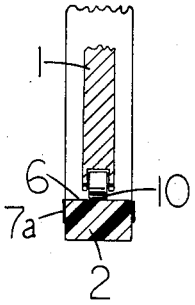
FIG. 7 is a section view of FIG. 6.

Four types of movable contact assemblies are illustrated in the drawings. The first contact assembly illustrated in FIGS. 1, 2, 3 and 8 consists of a conductive spring 4 and ball contact assembly. The second contact assembly illustrated in FIG. 4 consists of a conductive spring 8, socket 20 and ball contact 3 located in the socket. The third contact assembly consists of a conductive spring 4 and common brush contact 9 as illustrated in FIG. 5. The fourth contact assembly illustrated in FIGS. 6 and 7 consists of a conductive axle and roller contact 10.

Figure 8:
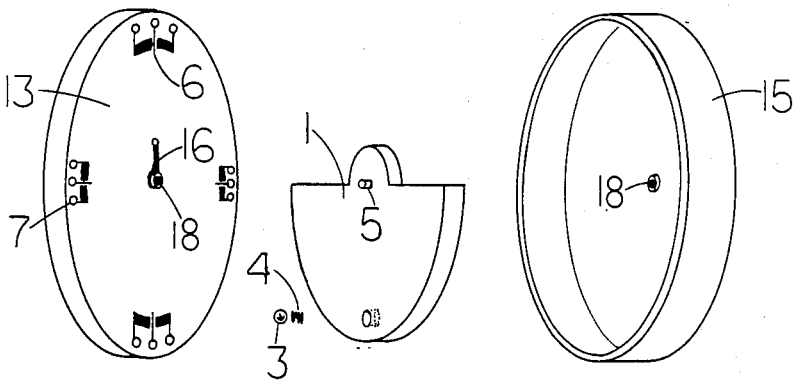
FIG. 8 is an exploded view of a further embodiment of my switch contact assembly.

The switch assembly in FIG. 8 represents the same basic principles and produces the same results as described above. This switch assembly comprises a backside housing 13, which is fitted into a frontside aperture cup housing 15, to form the general switch housing. The inside walls of the housings support a gravity sensitive rotor 1, in the same manner described above. However, the movable contact assembly 3 and 4 is located on or within either or both sides of the rotor 1 and interacts with stationary contacts 7, which are flush within the inside planar wall of the housing 13 and/or 15, to maintain the current flow.

The disclosure of the invention described hereinabove represents the embodiments of the invention. Variations in the form, construction, and arrangement of the various electrical or electronic components thereof and the modified application of the invention are possible without departing from the spirit and the scope of the appended claims.

What is claimed is:

1. A gravity sensing switch comprising a nonconductive housing consisting of a backside assembly plate and a frontside retainer plate, said plates given additional structural support by fastener means for holding the plates in a fixed position, said backside plate including an aperture cup and a centrally located conductive axle bearing boss, said frontside retainer plate including a centrally located conductive axle bearing boss, a power input terminal located on said backside plate, a conductive gravity sensitive rotor capable of a 360° rotation connected to a conductive axle mounted within said axle bearing bosses and electrically connected by said axle bearing bosses to said power input terminal, said conductive rotor containing a movable contact means on or within the periphery of said conductive rotor, said backside assembly plate further including pressure lug contacts electrically connected to informational output terminals, a non-conductive race disposed within said aperture cup, said race containing pressure lug contacts connected to stationary contacts located on the inner periphery of said race, said stationary contacts electrically connected to said informational output terminals by said race pressure lug contacts and said backside assembly plate pressure lug contacts, whereby various circuits are established upon movement of said rotor and the engagement of the movable contact means with at least one of said stationary contacts.

2. A gravity sensing switch comprising a backside housing and a frontside aperture cup housing, each of said housings having a conductive axle bearing boss, at least one conductive bearing boss connected to a power input conductor, a conductive gravity sensitive rotor having a conductive rotor axle for rotationally mounting said rotor in each of said axle bearing bosses, distinct movable contact means located on at least one side of said rotor, said movable contact means interacting with stationary contacts located on the inside planar wall of at least one of said housings, said rotor being structurally mounted within said housings for 360° rotation.

3. A gravity sensing switch as claimed in claim 1, wherein said movable contact means includes a conductive tension spring and ball.

4. A gravity sensing switch as claimed in claim 1, wherein said movable contact means includes a conductive tension spring, socket and said ball contact.

5. A gravity sensing switch as claimed in claim 1, wherein said movable contact means includes a conductive tension spring and common brush contact.

6. A gravity sensing switch as claimed in claim 1, wherein said movable contact means includes a conductive roller and axle.

* * * * *